United States Patent [19]

Hirata et al.

[11] 4,393,335

[45] Jul. 12, 1983

[54] ELECTRONIC FLASH DEVICE

[75] Inventors: Shinji Hirata, Toyonaka; Hirohiko Ina, Kobe, both of Japan

[73] Assignee: West Electric Co., Ltd., Osaka, Japan

[21] Appl. No.: 258,301

[22] Filed: Apr. 28, 1981

[30] Foreign Application Priority Data

Apr. 28, 1980 [JP] Japan ..... 55-59007[U]
May 30, 1980 [JP] Japan ..... 55-75659[U]

[51] Int. Cl.[3] ..... H05B 41/32

[52] U.S. Cl. ..... 315/241 P; 315/219; 315/240; 354/145

[58] Field of Search ..... 315/151, 159, 241 P, 315/156, 209 R, 219, 240; 354/145

[56] References Cited

U.S. PATENT DOCUMENTS 3,864,601 2/1975 Schneider ..... 315/241 P
4,323,822 4/1982 Yakematsu ..... 315/241 P

*Primary Examiner*—Eugene La Roche
*Attorney, Agent, or Firm*—Burgess, Ryan & Wayne

[57] ABSTRACT

In an electronic flash device of the type in which depending upon the exposure conditions an electronic flash lamp converts into light the energy stored on a main flash capacitor or the energies stored not only on the main flash capacitor but also on an auxiliary flash capacitor, a switching element which is turned on or off so as to permit or interrupt the discharge of the auxiliary flash capacitor is controlled by a simplified control circuit comprising a switching element control circuit which delivers a low voltage supplied from a low-voltage power source to the switching element as a turn-on signal and a detection circuit which controls the switching element control circuit in response to the exposure conditions such as a distance to a subject or a selected aperture. Therefore, an inversion circuit which is used in the prior art electronic flash devices can be eliminated.

3 Claims, 5 Drawing Figures

ELECTRONIC FLASH DEVICE

BACKGROUND OF THE INVENTION

The present invention relates to generally an electronic flash device and more particularly an electronic flash device of the type which has a main and an auxiliary flash capacitor so that when the quantity of light available from only the discharge of the main flash capacitor will result in an underexposure, the auxiliary flash capacitor is also discharged so that an adequate quantity of light can be flashed.

In the prior art electronic flash devices of the type described, the gate voltage to be applied to a silicon controlled rectifier or switching element which controls the discharge of the auxiliary flash capacitor must be high voltage, so that it is difficult to deliver the gate voltage to the switching element and subsequently the circuit of the electronic flash device is complex in construction.

SUMMARY OF THE INVENTION

In view of the above, one of the objects of the present invention is to provide an electronic flash device of the type described above in which a switching element which is turned on or off so as to permit or interrupt the discharge of an auxiliary flash capacitor is controlled by a simplified control circuit comprising a switching element control circuit which delivers a low voltage supplied from a low-voltage power source or supply to the switching element as a turn-on signal and a detection circuit which controls the switching element control circuit in response to the exposure conditions, whereby an inversion circuit used in the prior art electronic flash devices can be eliminated.

According to one aspect of the present invention, a diode is inserted so that the discharge of the auxiliary flash capacitor through a main flash capacitor can be prevented.

According to another aspect of the present invention, the switching element is controlled in response to the voltage charged across the main flash capacitor in such a way that unless the voltage across the main capacitor reaches a predetermined level, the switching element cannot be turned on. To put in another way, the switching element is maintained in the nonconduction state until the main flash capacitor is charged to a predetermined voltage level. Therefore, the damage to the switching element and the energy losses due to the discharge of the auxiliary flash capacitor through the main flash capacitor can be avoided.

The above and other objects, effects and features of the present invention will become more apparent from the following description of preferred embodiments thereof taken in conjunction with the accompanying drawings.

BRIEF DESCRIPTION OF THE DRAWINGS

Same reference numerals are used to designate similar parts throughout the figures.

DETAILED DESCRIPTION OF THE PRIOR ART

Figure 1:
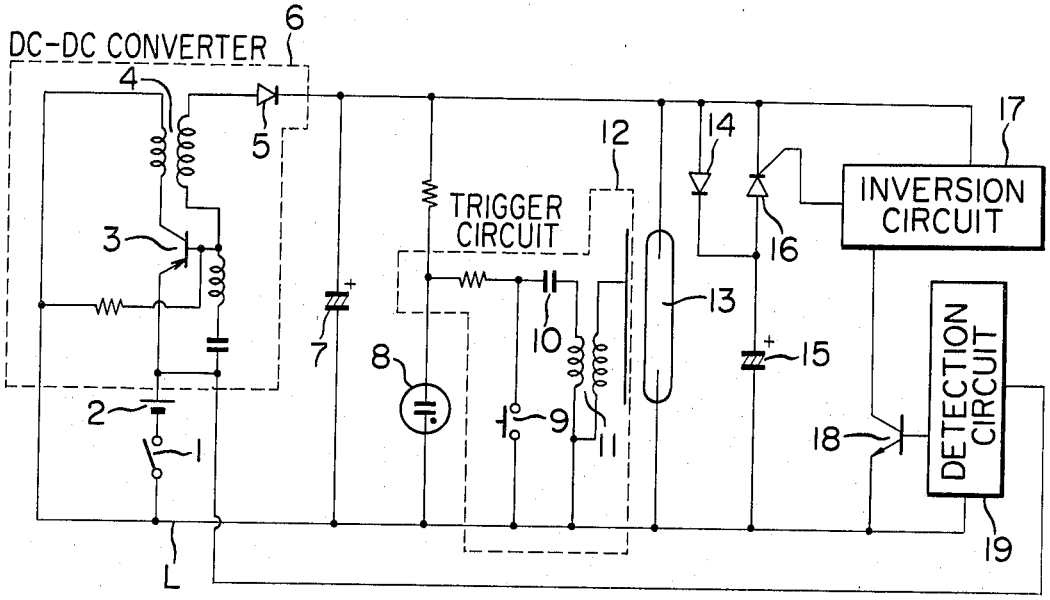
FIG. 1 PRIOR ART
FIG. 1 is an electronic circuit diagram of a prior art electronic flash device.

In FIG. 1 is shown a well known prior art electronic flash device of the type in which when the quantity of light flashed by the discharge of a main flash capacitor is not adequate to record an object on a film, an auxiliary capacitor is connected through a switching element to a flash lamp so as to compensate for the insufficient quantity of light.

When a power switch 1 is closed, a low-voltage power source 2 is connected to a DC-DC converter 6 comprising an oscillation transistor 3, an oscillation transformer 4 and a diode 5. The DC-DC converter 6 steps up the voltage supplied from the low-voltage power source 2 and delivers the stepped up voltage to a main flash capacitor 7 and to an auxiliary capacitor 15 through a diode 14, whereby the main and auxiliary capacitors 7 and 15 are charged.

When the charged voltage across the main flash capacitor 7 rises to a predetermined level adequate to light a flash lamp 13, a neon bulb 8 is turned on, indicating that the electronic flash device is ready to be actuated or triggered.

When a trigger switch 9 is turned on under these conditions, a trigger circuit 12 comprising a trigger capacitor 10 and a trigger transformer 11 is energized so as to deliver a trigger pulse to the flash lamp 13. Then, the flash lamp 13 is excited and lighted by converting the energy stored on the main flash capacitor 7 into a flash of light.

Next, the mode of operation of the auxiliary flash capacitor 15 will be described. A detection circuit 19 responds to a signal which is representative of the distance from a camera to an object and which is generated within the camera. When the detection circuit 19 detects that the quantity of light flashed by the conversion of the energy stored on the main flash capacitor 7 is not sufficient, it turns on a transistor 18 so that an inversion circuit 17 is energized. The circuit 17 delivers a gate signal to a silicon controlled rectifier or SCR 16 which is a switching element so that SCR 16 is turned on. As a consequence, the charge stored on the auxiliary capacitor 15 is delivered to the flash lamp 13.

The charge to be delivered to the flash lamp 13 from the auxiliary capacitor 15 can be controlled in response to a guide number set. That is, SCR 16 is controlled in response to the distance signal or aperture signal.

However, the electronic flash device of the type described above with reference to FIG. 1 has drawbacks to be described below.

The cathode of SCR 16 is connected to the positive terminal (+) of the main flash capacitor 7 which is charged to the order of 300 V. Therefore, it follows that if it is desired to start the discharge of the auxiliary capacitor 15 almost simultaneously when the discharge of the main flash capacitor 7 is started, a voltage which is slightly higher than the cathode voltage of the SCR 16 must be applied to the gate thereof. This is the reason why the inversion circuit 17 must be provided which may apply to the gate of SCR 16 a voltage as high as 300 V and which subsequently becomes complex in construction. If SCR 16 is inserted between the auxiliary capacitor 15 and the line L, a circuit must be added which maintains the cathode of the SCR 16 at a negative voltage. Therefore, the circuit also becomes complex in construction.

DESCRIPTION OF THE PREFERRED EMBODIMENTS

The present invention was made to eliminate the above and other drawbacks encountered in the prior art electronic flash devices. That is, in order to connect the cathode SCR 16, which controls the supply of the charge stored on the auxiliary capacitor 15 to the flash lamp 13, to the negative terminal of the low-voltage power source 2 so that the SCR 16 is connected in the forward direction, while a pnp type transistor 3 is used in the DC-DC converter 6, an npn type transistor 3*a* is used. As a result, the inversion circuit 17 and can be eliminated and the voltage of the low-voltage power source 2 can be directly applied as the gate signal to SCR 16, so that the circuit can be made simple in construction and small in size with a minimum number of components.

Figure 2:
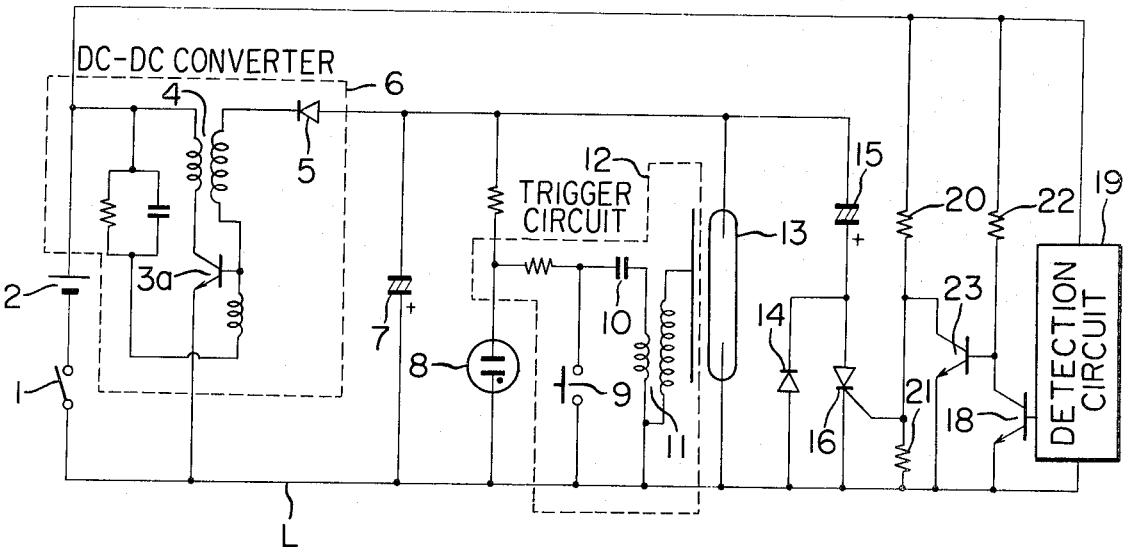
FIGS. 2 through 5 show electronic circuit diagrams, respectively, of first, second, third and fourth embodiments of the present invention.

In FIG. 2 is shown a first embodiment of an electronic flash device in accordance with the present invention. Fundamentally, the first embodiment is substantially similar in construction and mode of operation to the prior art electronic flash device shown in FIG. 1 except that the npn type transistor 3*a* is used. Since the npn type transistor 3*a* is used, the low-voltage line of the low-voltage power source 2 is connected to the high-voltage terminals of the main and auxiliary flash capacitors 7 and 15 and the negative terminal of the low-voltage power source 2 is connected to the cathode of SCR 16.

When the trigger switch 9 is turned on after the main and auxiliary flash capacitors 7 and 15 have been fully charged, the trigger circuit 12 is turned on so as to apply the trigger pulse to the flash lamp 13. The flash lamp 13 is lighted by converting the charge stored on the main flash capacitor 7.

When the power switch 1 is turned on, a transistor 23 is immediately turned on which receives the base current from the low-voltage power source 2 through a resistor 22, so that SCR 16 is turned off. Therefore, unless the transistor 23 is turned off, the charged stored on the auxiliary capacitor 15 through the diodes 5 and 14 is not discharged.

As with the prior art electronic flash device shown in FIG. 1, the detection circuit 19 responds to the distance or aperture signal so as to control the transistor 18. That is, when the detection circuit 19 turns on the transistor 18, the transistor 23 is turned off, so that the gate signal is applied from the low-voltage power source 2 through resistors 20 and 21. Since the cathode of the SCR 16 is connected to the low-voltage line L, SCR 16 can be turned on by applying a slightly high positive voltage to the gate thereof. When SCR 16 is turned on, the charge stored on the auxiliary flash capacitor 15 is supplied to the flash lamp 13.

As described above, the gate signal may be at a low level and the inversion circuit for generating a high voltage can be eliminated. Only the control circuit is added which responds to the output from the detection circuit 19 so as to control the application of the voltage supplied from the low-voltage power source 2 to SCR 16 as the gate signal. Thus, the present invention provides an electronic flash device which is compact in size with a minimum number of components and is inexpensive to fabricate as compared with the prior art electronic flash devices.

However, the electronic flash device of the type described previously has some problems. That is, when the voltage charged across the auxiliary capacitor 15 becomes higher than that across the main flash capacitor 7 and SCR 16 is turned on; that is, when the flash lamp 13 was once lighted without the use of the energy stored on the auxiliary flash capacitor 15 and the next exposure needs the charge stored on the auxiliary flash capacitor 15, there occurs a phenomena that the auxiliary flash capacitor 15 is immediately discharged through the main flash capacitor 7. As a result, an extremely high current flows through the closed loop comprising the auxiliary flash capacitor 15, SCR 16 and the main flash capacitor 7, so that if SCR 16 has not maximum ratings, it is damaged. Therefore, in the selection of SCR 16 there arises a cumbersome problem that the maximum ratings when the auxiliary flash capacitor 15 is discharged through the flash lamp 13 and when it is discharged through the above-described closed loop must be taken into consideration.

The establishment of the closed loop means that the charging follows the immediate discharge of the auxiliary flash capacitor 15 and consequently that the energy stored on the auxiliary flash capacitor 15 is wasted for nothing; that is, without lighting the flash lamp 13. As a result, the energy utilization efficiency of the power source 2 considerably drops. This problem is also overcomed by the present invention as will be described in detail below.

Figure 3:
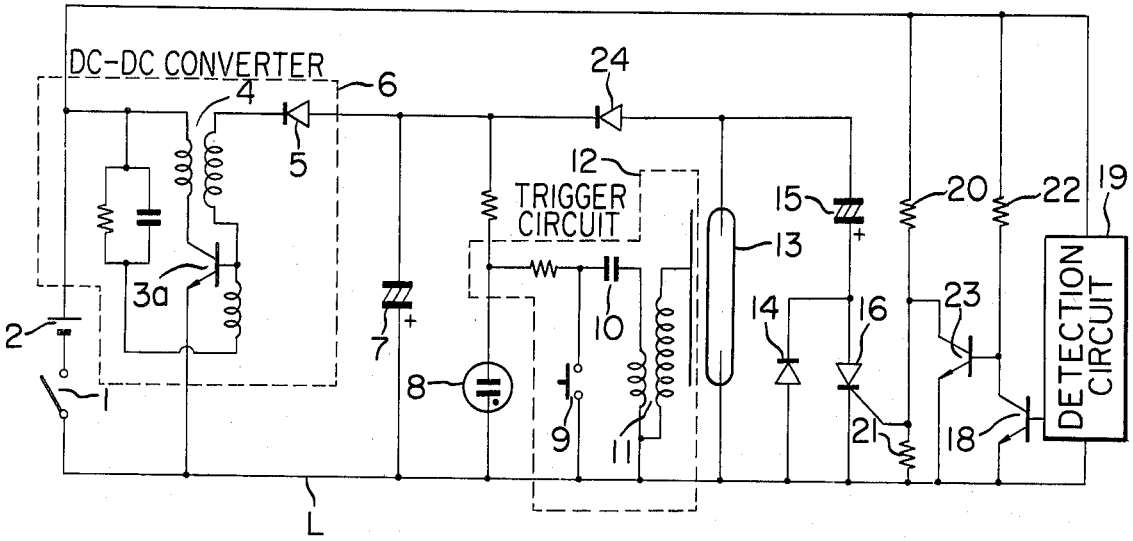

In FIG. 3 is shown a second embodiment of the present invention which is substantially similar in construction to the first embodiment described above with reference to FIG. 2 except that a diode 24 is inserted in order to prevent the damage to SCR 16 and to avoid the energy losses of the type described previously. The diode 24 is inserted in the closed loop comprising the auxiliary flash capacitor 15, SCR 16 and the main flash capacitor 7 at such a position that the operation of the transistor 23 which controls the SCR 16 may not be adversely affected.

Figure 4:
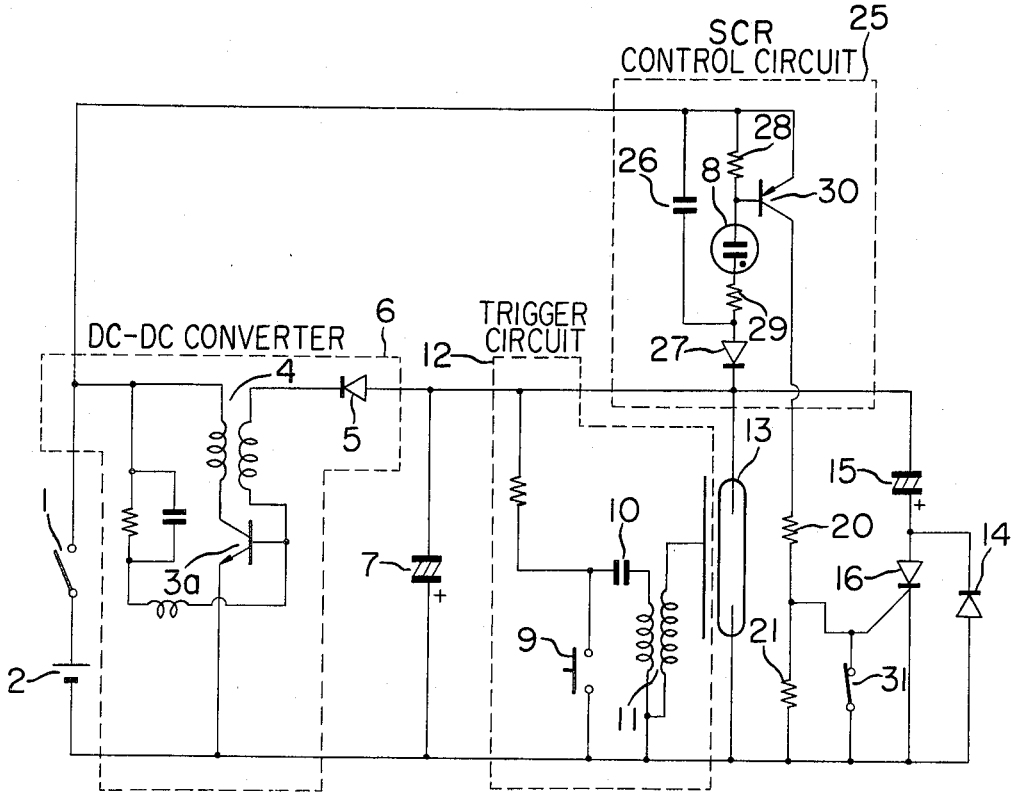

In FIG. 4 is shown a third embodiment of the present invention which includes a SCR control circuit 25 comprising a capacitor 26, a diode 27, resistors 28 and 29 and a transistor 30. A switch 31 is inserted in order to perform the same function as the transistor 18, the detection circuit 19 and the transistor 23 in the first embodiment. It is controlled in response to the aperture setting operation. That is, when an under-exposure is expected with the quantity of light flashed by the conversion of only the energy stored on the main flash capacitor 7, the switch 31 is turned off, so that when the gate signal is applied to SCR 16 the auxiliary flash capacitor 15 is discharged through the flash lamp 13.

In the third embodiment, the SCR 16 is controlled not only by the exposure conditions (for instance, an aperture) as described above but also by the condition of the main flash capacitor 7. In order words, the SCR 16 is turned on only when an exposure is made with a flash of light produced by the conversion of the energy stored on the main flash capacitor 7 only and when the main flash capacitor 7 has been charged to a predetermined level. In addition, even when discharge of the auxiliary flash capacitor 15 through the main flash capacitor 7 occurs in the manner described elsewhere, the voltage difference between the main and auxiliary flash capacitors 7 and 15 can be maintained as minimum as possible so that the damage to SCR 16 and the energy losses can be avoided.

When the power switch 1 is turned on, the DC-DC converter 6 is turned on, so that the main and auxiliary flash capacitors 7 and 15 and the trigger capacitor 10 are charged as described previously. Simultaneously, the capacitor 26 in the SCR control circuit 25 which is connected in parallel with the main flash capacitor 7 through the power switch 1, the low-voltage power source 2 and the diode 27 is also charged. The voltage charged across the capacitor 26 is the voltage charged across the main flash capacitor 7 plus the voltage across the low-voltage power source 2 and is substantially proportional to the voltage across the main flash capacitor 7.

When the main flash capacitor 7 is charged to a predetermined level at which the flash lamp 13 can be lighted, the neon bulb 8 is turned on. As a result, a current flows through a series circuit consisting of the resistor 28, the neon bulb 8 and the diode 27. Then, due to the voltage drop across the resistor 28, the base-emitter junction of the transistor 30 is forward biased, so that the transistor 30 is turned on and consequently the current flows to the gate of SCR 16 through the resistors 20 and 21. More particularly, when the switch 31 is turned off in response to the exposure conditions, the voltage drop across the resistor 21 is applied to the gate signal to SCR 16, so that the latter is turned on.

On the other hand, when the switch 31 is turned on; that is, when an exposure can be made with the quantity of light available only from the discharge of the main flash capacitor 7, the resistor 21; that is, the gate-cathode junction of SCR 16 is short-circuited by the closed switch 31, so that no gate signal is produced and consequently SCR 16 is not turned on.

As described above, according to the third embodiment, when the switch 31 remains turned off and if the main flash capacitor 7 has been already charged to a predetermined level, SCR 16 is turned on. In other words, SCR 16 is turned on only when exposure conditions need the quantity of light flashed by the discharge of both the main and auxiliary flash capacitors 7 and 15 and only after the main flash capacitor 7 has been already charged to a predetermined voltage level. Therefore, even when the discharge of the auxiliary flash capacitor 15 through the main flash capacitor 7 should occur as described previously, the main flash capacitor 7 has been already charged to a predetermined voltage level, so that the voltage difference between the main and auxiliary flash capacitors 7 and 15 is very small and subsequently adverse effects caused by the discharge through the main flash capacitor 7 can be substantially eliminated. In other words, due to a small difference in voltage between the main and auxiliary flash capacitors 7 and 15, only a small current flows through SCR 16, so that the resulting energy loss is small.

When the trigger switch 9 is turned on after both the main and auxiliary flash capacitors 7 and 15 have been charged to a predetermined level, the quantity of light flashed by the flash lamp 13 is controlled depending upon the condition or state of SCR 16. That is, when the switch 31 is turned on so that SCR 16 is maintained in the nonconduction state, only the main flash capacitor 7 is discharged, but when the switch 31 is turned off, the energy stored on both the main and auxiliary capacitors 7 and 15 is converted into a flash of brilliant light by the flash lamp 13.

Figure 5:
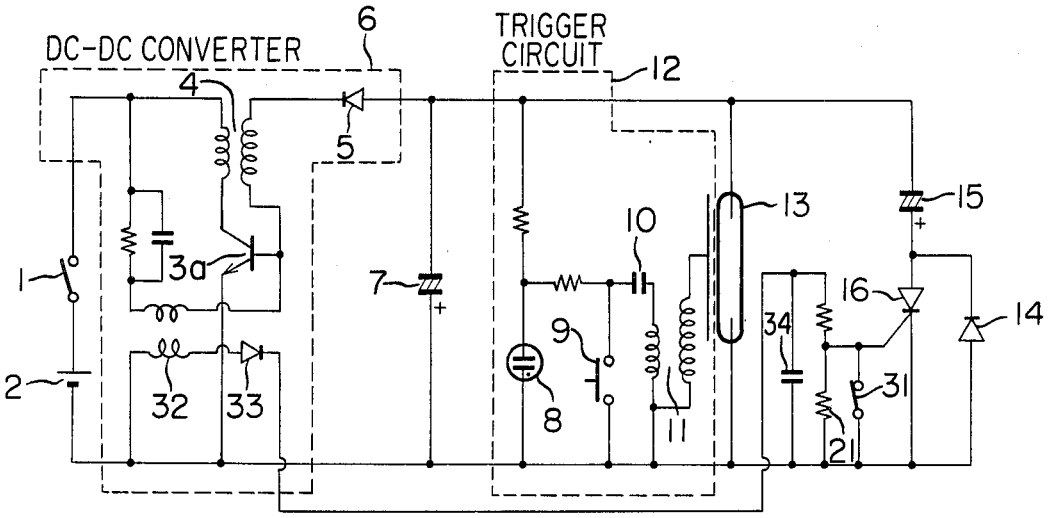

In FIG. 5 is shown a fourth embodiment of the present invention which is substantially similar to the third embodiment described above with reference to FIG. 4 except that the SCR control circuit 25 is eliminated and instead a charging circuit comprising an additional winding 32 and a rectifying diode 33 for rectifying the AC current induced in the winding 32 into the DC current is added in the DC-DC converter 6 in order to charge a capacitor 34 connected in parallel with the resistors 20 and 21.

When the power switch 1 is turned on, the DC-DC converter 6 is turned on, so that the main and auxiliary flash capacitors 7 and 15, the trigger capacitor 10 and the capacitor 34 are charged as described previously. The voltage charged across the capacitor 34 is dependent upon a turn ratio between the additional winding 32 and one of the primary and secondary windings of the DC-DC converter 6 which is electromagnetically coupled with the additional winding 32. Therefore, the voltage charged across the capacitor 34 is in proportion to the voltage charged across the main flash capacitor 7 and is divided by the resistors 20 and 21, so that the voltage across the resistor 21 is applied as the gate signal to SCR 16 if the switch 31 is turned off.

As described previously, the switch 31 is turned on or off in response to the exposure conditions. For instance, when it is detected that an under-exposure will result with the quantity of light available from the discharge of the main flash capacitor 7 only, the switch 31 is turned off, so that the voltage drop across the resistor 21 is applied as the gate signal to the SCR 16 and subsequently when the voltage across the capacitor 34 and hence the voltage across the resistor 21 exceeds a predetermined level, SCR 16 is turned on.

In the fourth embodiment, the turn ratio between the additional winding 32 and its magnetically coupled primary or secondary winding of the DC-DC converter 6 and the ratio between the resistors 20 and 21 are so selected that only after the main flash capacitor 7 has been charged to a predetermined voltage level at which the flash lamp 13 can be lighted, the capacitor 34 is charged to a predetermined voltage level at which SCR 16 is turned on if the switch 31 is turned off. As a consequence, adverse effects due to the discharge of the auxiliary flash capacitor 15 through the main flash capacitor 7 can be substantially eliminated. As in the case of the third embodiment, when the trigger switch 9 is turned on, the quantity of light flashed by the flash lamp 13 is dependent on whether the switch 31 is turned on or off and consequently whether SCR 16 is turned off or on.

What is claimed is:

1. An electronic flash device comprising (a) a DC-DC converter which includes an npn type oscillation transistor and an oscillation transformer and which steps up a voltage across a low-voltage power source, (b) a main flash capacitor charged by said DC-DC converter, (c) a flash lamp which is connected across said main flash capacitor and which establishes a discharge-flash loop with said main flash capacitor, (d) a trigger circuit which includes a trigger capacitor connected in parallel with said main flash capacitor and which excites said flash lamp, (e) a diode whose anode is connected to the high-voltage-side terminal of said main flash capacitor, (f) an auxiliary flash capacitor which is adapted to be charged through said diode by said DC-DC converter, (g) a silicon controlled rectifier means which is connected across said diode in the opposite direction and which establishes a discharge loop of said auxiliary flash capacitor, (h) a control circuit which is connected across said low-voltage power source and which controls the application of the gate signal to said silicon controlled rectifier means, said control circuit comprising:

(1) a drive circuit for delivering the gate signal to said silicon controlled rectifier means, (2) a switching element which is connected across said low-voltage power source through a resistor and which is adapted to short-circuit the gate of said silicon controlled rectifier means, and (3) a switching element control circuit for controlling said switching element, and (i) a detection circuit which is adapted to control said control circuit in response to the exposure conditions.

2. An electronic flash device as set forth in claim 1 in which in order to avoid the establishment of a discharge loop for said auxiliary flash capacitor, a diode for interrupting the discharge current from said auxiliary flash capacitor is inserted in a discharge loop comprising said main flash capacitor and said auxiliary flash capacitor at such a position that interruptions to the charging and discharging of said main flash capacitor and to the supply of the power to said control circuit connected across said low-voltage power source are avoided.

3. An electronic flash device as set forth in claim 1 further comprising a voltage detection circuit for detecting the voltage charged across the main flash capacitor and delivering the detected voltage to said control circuit so that said silicon controlled rectifier means is turned on only and only when the quantity of light available from the discharge of said main flash capacitor only will cause an under-exposure and only after said main flash capacitor has been charged to a predetermined voltage level.

* * * * *